United States Patent [19]

Sarcia et al.

[11] 4,259,844

[45] Apr. 7, 1981

[54] STACKED DISC HEAT EXCHANGER FOR REFRIGERATOR COLD FINGER

[75] Inventors: Domenico S. Sarcia, Carlisle; John T. Harvell, Lexington; Robert M. Lewis, Hudson, all of Mass.

[73] Assignee: Helix Technology Corporation, Waltham, Mass.

[21] Appl. No.: 61,919

[22] Filed: Jul. 30, 1979

[51] Int. Cl.[3] ..... F25B 9/00

[52] U.S. Cl. ..... 62/6; 165/10

[58] Field of Search ..... 62/6; 165/4, 10; 60/526

[56] References Cited

U.S. PATENT DOCUMENTS

| | | | |
|---|---|---|---|
| 1,776,162 | 9/1930 | Martinka | 60/526 |
| 2,897,655 | 8/1959 | Jonkers et al. | 62/6 |
| 2,899,381 | 8/1959 | Jonkers | 62/6 |
| 2,900,798 | 8/1959 | Jonkers | 62/6 X |
| 3,188,818 | 6/1965 | Hogan | 62/6 |
| 3,213,640 | 10/1965 | Dubinsky et al. | 62/6 X |
| 3,600,903 | 8/1971 | Chellis | 62/6 |
| 3,692,095 | 9/1972 | Fleming | 62/6 X |
| 3,874,442 | 4/1975 | Johnsson | 165/10 |
| 3,996,997 | 12/1976 | Regan et al. | 165/10 |

*Primary Examiner*—Lloyd L. King

*Attorney, Agent, or Firm*—Hamilton, Brook, Smith & Reynolds

[57] ABSTRACT

A stacked disc heat exchanger for a refrigerator cold finger includes a plurality of discs positioned within a cold finger cylinder and clamped to a cylinder end plate. Radial gas flow passages between the plates join inner and outer longitudinal gas flow passages. The radial passages provide a large surface area for contacting refrigeration gas and effecting efficient heat exchange with a load attached to the end plate. In a preferred embodiment the radial passages are flat grooves in the faces of discs. The stack of discs provides ease in assembly and great flexibility in designing the heat exchanger for particular applications.

11 Claims, 8 Drawing Figures

STACKED DISC HEAT EXCHANGER FOR REFRIGERATOR COLD FINGER

TECHNICAL FIELD

This invention relates to refrigerators and specifically to a heat exchanger for reducing the thermal gradient between a refrigerator gas and a load.

BACKGROUND ART

In cryogenic refrigerators, such as the Stirling and Gifford-MacMahon cycle refrigerators, a displacer piston reciprocates within a cold finger cylinder betweem warm and cold ends. An internal displacer regenerator or an external regenerator carries working fluid between the warm and cold ends. Refrigeration gas is cooled as it flows through the regenerator and is then further cooled by expansion in an expansion chamber at the cold end of the displacer. The thus cooled gas is then able to absorb heat from a load mounted to the refrigerator station or stations of the cold finger.

As was noted in Chellis et al., U.S. Pat. No. 3,600,903, to provide maximum heat exchange, and thus a low thermal gradient, between the load and the refrigeration gas, it is desirable that the gas contact a large heat transfer surface at each refrigeration station. However, when the displacer moves to the cold end the expansion chamber should be very small so that most gas is exhausted through the regenerator. For that same reason, the void volume in the gas flow path between the regenerator and the expansion chamber should be very small. To obtain the high transfer surface with low void volume, Chellis et al. provided narrow fluid passages along the outer walls of the cold finger. Refrigeration gas flowing from the regenerator to the expansion chamber flowed through those narrow passages.

This invention incorporated the basic principles of Chellis et al. in that the heat exchange efficiency of a cold finger is improved by providing a large heat transfer surface with high heat transfer coefficient but with minimum void volume.

An object of the invention is to provide a cold finger heat exchange assembly which allows for exceptional ease in the manufacture of the refrigerator units.

A further object of the invention is to provide a heat exchanger assembly which offers design flexibility with respect to heat transfer surface and void volume as required for any particular application.

DISCLOSURE OF THE INVENTION

In a refrigeration system having a refrigeration gas flowing in heat exchange relationship with a load, a heat exchanger assembly is formed of a stack of plates of high thermal conductivity material. The plates have an inner longitudinal gas flow passage therethrough defined by a hole through each of the plates. The plates are at least partially spaced from each other to define a plurality of radial gas flow passages from the central passage to an outer longitudinal gas flow passage.

In the preferred embodiments the plates are discs within a cold finger cylinder. An expansion chamber is located between a regenerative displacer and the stack of discs. A load is mounted at the end of the stack of discs opposite to the expansion chamber.

In a preterred embodiment, the radial gas flow passages are formed by flat radial grooves in the disc faces.

The periphery of the discs are cut in at the end of each groove to form an outer longitudinal gas flow passage.

In a two stage refrigerator embodiment of the invention, a tube connecting two regenerators reciprocates within the stack of discs and radial ports communicate with an annular space between the discs and tube.

The discs are preferably clamped to an end plate by bolts. A thermal load is secured to the endplate.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

BEST MODE OF CARRYING OUT THE INVENTION

Figure 1:
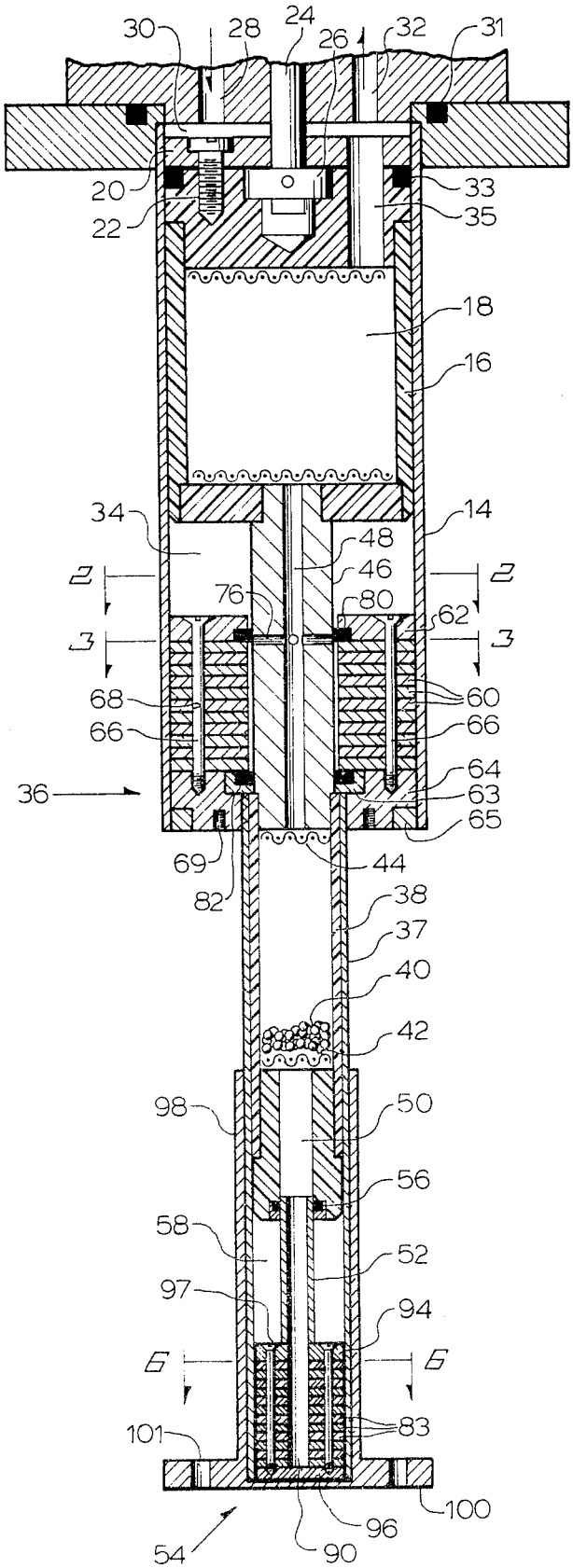
FIG. 1 is an elevational cross-sectional view of a cold finger in a two stage refrigerator embodying the present invention.
Figure 2:
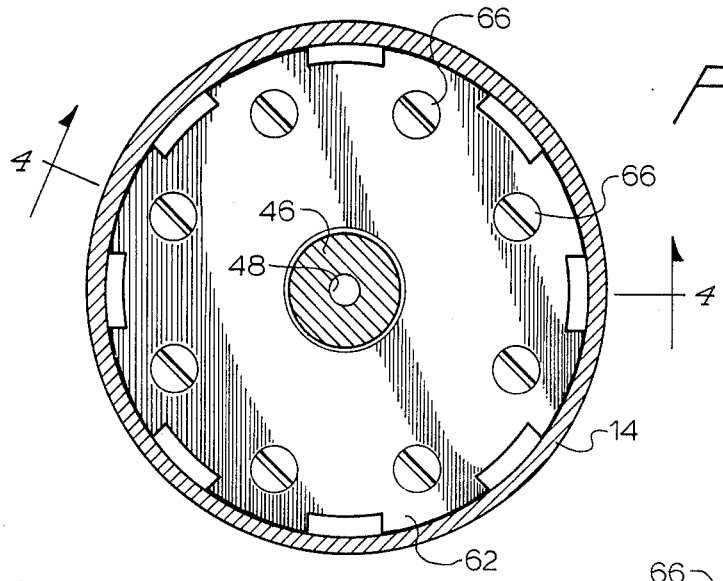
FIG. 2 is a cross-sectional view of the first stage of the refrigerator of FIG. 1 taken along line 2—2 and showing the heat exchanger clamping plate.
Figure 3:
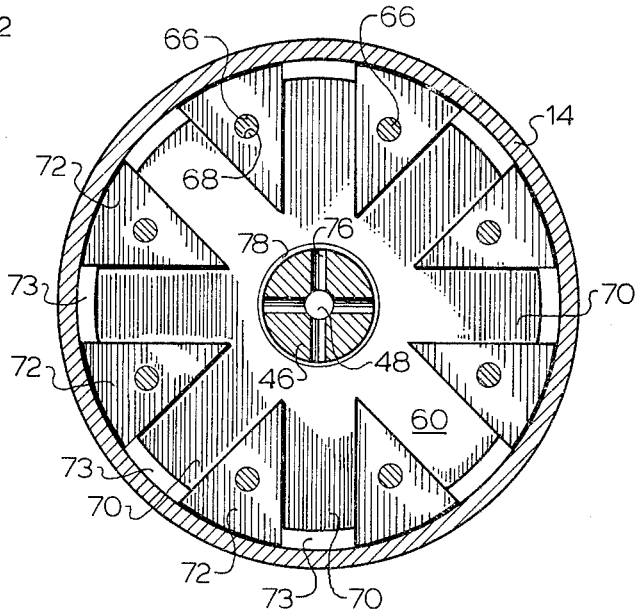
FIG. 3 is a cross-sectional view taken along line 3—3 of FIG. 1 and showing a heat exchanger disc.
Figure 4:
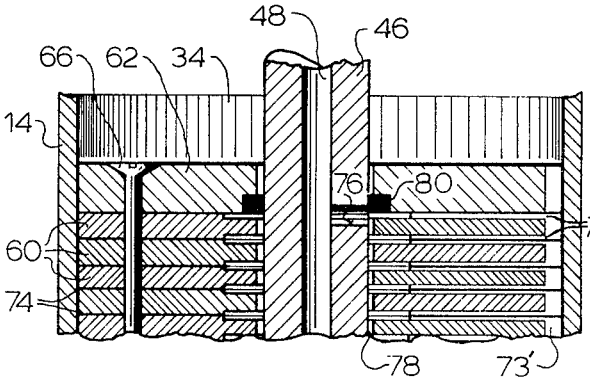
FIG. 4 is a partial elevational sectional view taken along line 4—4 of FIG. 2 and showing the thermal bonding wedges to the left and the radial gas flow passages to the right of the FIG.
Figure 5:
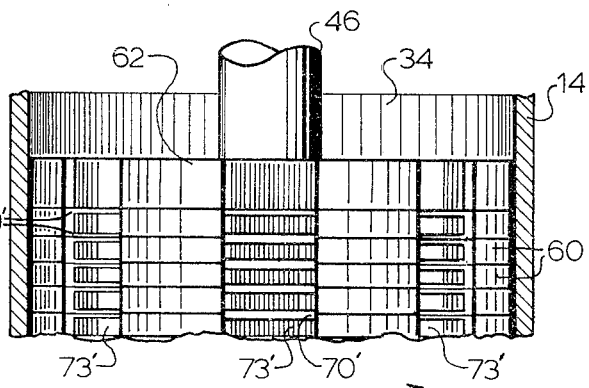
FIG. 5 is a partial side view of the refrigerator of FIG. 1 with the cold finger cylinder broken away to show the heat exhanger with its outer longitudinal gas flow passages.

A two stage cryogenic refrigerator cold finger is shown in FIG. 1. Except for the heat exchanger described below, this cold finger is conventional.

The refrigerator includes a first stage cold finger cylinder 14 through which a regenerative displacer 16 is free to reciprocate. The displacer is packed with regenerative material, such as copper mesh 18.

The displacer 16 is driven by a reciprocating shaft 24 having an end collar 26 clamped to the displacer by a plate 20. The plate 20 is secured to the displacer by a number of bolts such as at 22. During part of the refrigeration cycle high pressure refrigeration gas enters the cold finger through an inlet port 28 into a cylinder head space 30. During another part of the refrigeration cycle, the refrigeration gas is exhausted through an exhaust port 32. O-rings 31 and 33, or other suitable seals assure that pressurized gas entering the cold finger through inlet port 28 flows from the head space 30 through the regenerative packing 18 to a second stage connecting passage 48 in connecting tube 46. A heat exchanger assembly 36 closes the lower end of the cylinder 14. A space 34 between the displacer 16 and heat exchanger assembly 36 is the expansion chamber of the first stage.

The cylinder 37 of the second stage is of a lesser diameter than the cylinder 14. A second stage regenerative displacer 38 reciprocates in the cylinder 37. This displacer also contains regenerative packing material, but in this case it is in the form of lead balls 40 sandwiched between wire mesh 42 and 44.

A central bore 50 at the lower end of the displacer 38 rides along a duct 52 extending upwardly from a second stage heat exchanger assembly 54. A seal ring 56 assures that gas flow from the regenerative matrix 40 is directed to the second heat exchanger assembly 54. The second stage expansion chamber is the space 58 between the displacer 38 and the heat exchanger assembly 54.

The first stage heat exchanger 36 includes a plurality of disc 60 clamped in a stack between a clamping plate 62 and an end plate 64. The end plate 64 is soldered to stainless steel rings 63 and 65 which are in turn welded to the respective stainless cylinders 37 and 14. The plates of the heat exchanger assembly are clamped together by elongated bolts 66 which extend through the bolt holes 68 in the disc plates. Threaded holes 69 are provided for mounting a cryopump shroud or some other load to the plate 64.

The heat exchanger 36 is shown in detail in FIGS. 2–5. Each disc 60 is compressed in a coining operation to form a number of flat radial grooves 70. The grooves 70 are separated by raised sectors 72. After coining, the periphery of each disc is machined at the end of each groove to provide peripheral cut-ins 73.

With the discs clamped together, the raised sectors 72 are thermally bonded at interfaces 74. The plates are, however, spaced from each other at the grooves 70 to form radial gas flow passages 70'. The discs are high thermal conductivity material, preferably copper, to provide good heat exchange between the gas and a load. The discs may be of other material having a thermal conductivity coefficient in the order of that of copper or greater.

A central hole through each disc is slightly larger in diameter than the connecting tube 46 extending between the regenerative displacers. This leaves an annular space 78 which is in fluid communication with the connecting passage 48 by means of radial ports 76. Along the inner face of the cylinder 14, the cut-ins 73 are aligned to provide outer longitudinal gas passages 73' which join the radial passages 70' with the expansion chamber 34.

Upper and lower seal rings 80 and 82 insure that gas from the ports 76 is directed through the radial passages between the discs.

Figure 6:
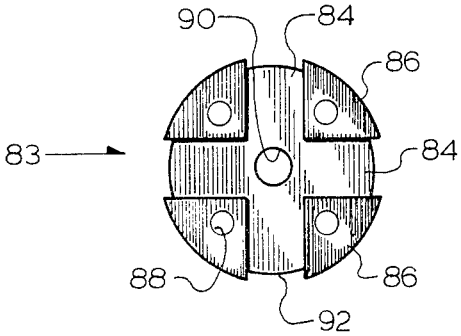
FIG. 6 is a plan view of a disc in the second stage heat exchanger as taken along line 6—6 of FIG. 1.

The lower heat exchanger assembly 54 has a structure similar to that of heat exchanger assembly 36 except that each disc 83 (FIG. 6) has only four radial grooves spaced by four raised sectors 86. A bolt hole 88 passes through each sector. Central holes 90 through the discs are aligned to form a longitudinal gas flow passage from the duct 52. Peripheral cut-ins 92 provide outer longitudinal gas flow passages as did the cut-ins 73 of the first stage exchanger assembly.

The clamping plate in the second stage is a flange 94 on the duct 52. The flange 94 and discs 83 are clamped to an end plate 96 by bolts 97. The assembly is completed by a high thermal conductivity cold tip 98 which surrounds the lower end of the cylinder 37. This cold tip 98 has a flange 100 which serves as a mounting plate for a cryopump shroud or the like. For that purpose threaded holes 101 are provided. As an alternative the cold tip might not suround the cylinder 37.

In operation, high pressure gas is introduced into the cold finger through the inlet port 28 while the two regenerative displacers 16 and 38 are in their lowermost positions (not shown). In that position the expansion chambers 34 and 58 have minimum volumes. Pressurized gas passes through the gas passages 35 and the regenerative packing material 18 and is thereby cooled to a first stage temperature. Some of that cooled gas continues through the connecting passage 48 to the regenerative packing 40 in the second stage displacer 38. It is thus further cooled to the second stage temperature. That further cooled gas passes downwardly through the bore 50 and duct 52 into the longitudinal gas passages and the radial passages formed by the stack of heat exchanger discs 83.

Other of the gas cooled in the first stage passes through radial ports 76 into the annular space 78. That gas fills the radial passages 70' and the outer longitudinal passage 73'.

The displacer assembly is then moved upwardly by shaft 24 thereby increasing the volumes of the expansion chambers 34 and 58. High pressure gas is thus drawn through the annular space 78 and the central passage 90', radial gas flow passages 70' and 84', and outer longitudinal passages 73' and 92' to the expansion chambers.

When gas is then exhausted through the exhaust port 32, pressurized gas in the expansion chambers 34 and 58 expands and thus cools. The displacer assembly is returned to its lowermost position causing most of the cooled gas to pass in a reverse direction back through the outer longitudinal passages 73' and 92' and the radial passages 70' and 84'. The gas is exhausted through the regenerative matrix and extracts heat therefrom.

In order that substantially all of the cooled gas is passed back through the regenerative matrices, it is important that the voids in the heat exchanger assemblies be held to a minimum. This result is attained by the very thin flat grooves provided in the discs. It is also important that there be good heat exchange between the gas and the heat load mounted to respective end plates 64 and 100. This is accomplished by the extensive gas contacting surface area provided in the grooves 84 and 70. Also, the thermal bonding of the discs at interfaces 74 provides a high conductivity thermal path from the load to the gas contacting surfaces. It should be recognized that the void volume, the gas contacting surface area and the gas passage cross-sectional area can be readily set to meet various design requirements. For example, by simply increasing the number of discs in a stack, one increases the gas contacting surface area as well as the void volume. To provide a minimum void volume per surface area the flat radial grooves 70 and 84 should be coined to a minimum depth which still provides unrestricted gas flow. Of course, as the number of discs is varied the length of the cold finger cylinder must also be adjusted to provide an expansion chamber of predetermined volume.

Figure 7:
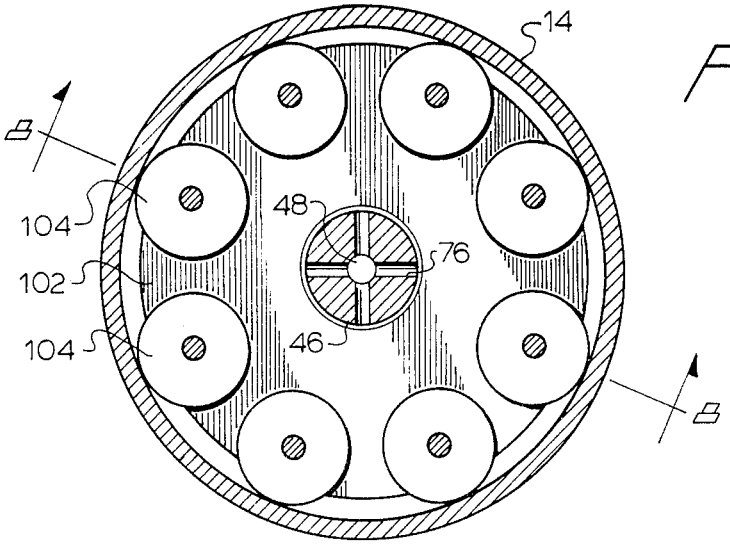
FIG. 7 is a view similar to FIG. 3 but showing an alternative form of the invention in which flat discs are spaced by washers.
Figure 8:
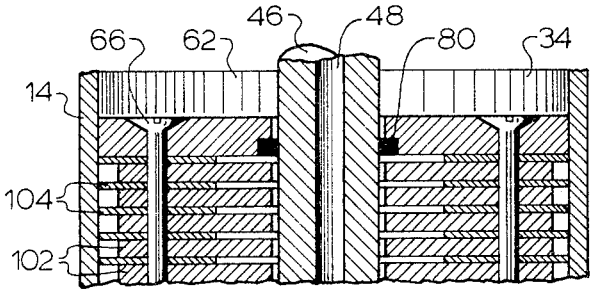
FIG. 8 is a cross-sectional view of the embodiment of FIG. 7 taken along line 8—8.

A second embodiment of the heat exchanger assembly 36 is shown in FIGS. 7 and 8. In that embodiment, the discs are not coined or machined. Rather, discs having flat faces are separated slightly by washers. Specifically, high conductivity washers 104 are provided between each two discs 102. The bolts 66 pass through the washers as well as holes in the discs, and the discs and washers are clamped as before by a clamping plate 62. The stack of discs and washers is thus thermally bonded to provide a high conductivity thermal path from each disc to the end plate 64. As with the first embodiment, the gas contacting surface area can be set by the number of discs used in the heat exchanger assembly. Also, the void volume can be reduced by decreasing the thickness of the washers.

It should be recognized that the washers need not extend to the cylinder wall 14 as shown in FIGS. 7 and 8. And the discs 102 may have an outer diameter about equal to the inner diameter of cylinder 14 with cut-ins provided as in the first embodiment .

The embodiment of FIGS. 7 and 8 avoids the coining operation and also avoids the need for machining cut-ins. However, it does require a large number of washers which complicate the assembly operation.

While the invention has been particularly shown and described with reference to preferred embodiments thereof, it will be understood by those skilled in the art that various changes in form and etails may be made therein without departing from the spirit and scope of the invention as defined by the appended claims. For example, in the coined disc embodiment the grooves need only be provided on one face of each disc or on both faces of alternate discs. One-way valves shown in the Chellis et al. patent may be provided so that gas flow is in only one direction through the heat exchanger assemblies. The seals shown might actually be of U-cross section or any other configuration and the regenerators may include any regenerative matrices. Also those regenerators may be external to the cylinder. Alternative methods of joining the discs include diffusion bonding and soldering. Lead-tin solder has been used successfully.

INDUSTRIAL APPLICABILITY

This invention relates to heat exchangers for providing a low temperature difference between a heat load and a refrigeration gas. It has particular application in cryogenic regrigerators such as Stirling cycle and Gifford-MacMahon cycle refrigerators wherein a regenerative displacer reciprocates within a cold finger cylinder.

We claim:

1. In a refrigeration system having a refrigeration gas which is expanded and thus cooled and which flows in heat exchange relationship with a load, heat exchange being through a refrigerator wall, a heat exchanger assembly comprising:

a stack of a plurality of plates of high thermal conductivity material, the plates having a substantial face-to-face thermal contact;

the stack of plates having an inner longitudinal refrigeration gas flow passage therethrough defined by a hole through each of the plurality of plates;

the plates being at least partially spaced from each other along radial grooves formed in the plates to define a plurality of flat radial refrigeration gas flow passages between the plates from the inner gas flow passage to at least one outer longitudinal gas flow passage; and the stack of plates providing large-area refrigeration gas-contacting surfaces and a high thermal conductivity heat transfer path from the gas contacting surfaces to a load mounted to the stack.

2. A heat exchanger as claimed in claim 1 and positioned in a cylinder wherein the outer longitudinal gas flow passage is formed of peripheral cut-ins in the plates.

3. A heat exchanger assembly as claimed in claim 1 wherein the plates are clamped together by bolts.

4. A refrigerator comprising:

a cylinder;

a regenerative displacer within the cylinder;

a stack of a plurality of discs of high thermal conductivity material within and concentric with the cylinder at one end thereof, the stack of discs and the displacer defining a refrigeration gas expansion chamber therebetween, the discs having substantial face-to-face thermal contact; and a refrigeration gas flow path to the expansion chamber through the regenerative displacer, an inner longitudinal passage in the stack of discs, radial passages between the discs and an outer longitudinal passage;

the stack of discs providing large-area refrigeration-gas-contacting surfaces and a high thermal conductivity heat transfer path from the gas contacting surfaces to a load thermally bonded to the end of the stack opposite to the expansion chamber.

5. A refrigerator comprising:

a cold finger cylinder closed at one end by a high thermal conductivity end plate;

a regenerative displacer within the cylinder;

a stack of a plurality of discs of high thermal conductivity material within and concentric with the cylinder and clamped to each other and to the end plate, the stack of discs and the displacer defining a refrigeration gas expansion chamber therebetween, the discs having substantial face-to-face thermal contact, and a refrigeration gas flow path to the expansion chamber through the regenerative displacer, an inner longitudinal passage in the stack of discs, radial passages between the discs, and an outer longitudinal passage;

the stack of discs providing large-area refrigeration-gas-contacting surfaces and a high thermal conductivity heat transfer path from the gas contacting surfaces to a load thermally bonded to the end plate.

6. A refrigerator as claimed in claim 4 or 5 wherein the radial passages between the discs comprise flat radial grooves in faces of the discs.

7. A refrigerator as claimed in claim 6 wherein the outer longitudinal passage is formed from peripheral cut-ins in the discs.

8. A refrigerator as claimed in claim 4 or 5 wherein the discs are clamped together by bolts.

9. A refrigerator as claimed in claim 4 or 5, that refrigerator being a two stage refrigerator, wherein a displacer-connecting tube extends through a central hole in each disc in the stack, the tube having a radial port communicating with the radial passages.

10. A refrigerator as claimed in claim 9 wherein the diameter of the hole in each disc is slightly greater than the diameter of the connecting tube and the discs are clamped between seal retaining plates, the inner longitudinal passage being an annular space between the tube and disc.

11. A refrigerator as claimed in claim 10 wherein the discs are clamped by bolts.

* * * * *